United States Patent [19]

Jönsson

[11] Patent Number: 4,671,802

[45] Date of Patent: Jun. 9, 1987

[54] CHEMICAL ENHANCED FUEL PEAT DEWATERING

[75] Inventor: Bengt Jönsson, Genarp, Sweden

[73] Assignee: Lars Stigsson, Bjarred, Sweden

[21] Appl. No.: 849,769

[22] Filed: Apr. 9, 1986

[30] Foreign Application Priority Data

Apr. 9, 1985 [SE] Sweden ..... 8501722

[51] Int. Cl.[4] ..... C10F 7/06

[52] U.S. Cl. ..... 44/27; 44/32; 44/33

[58] Field of Search ..... 44/27, 32, 33

[56] References Cited

U.S. PATENT DOCUMENTS 2,146,902 2/1939 Martin ..... 44/27

FOREIGN PATENT DOCUMENTS 385015 4/1908 France ..... 44/27

*Primary Examiner*—Curtis R. Davis

*Attorney, Agent, or Firm*—Merchant, Gould, Smith, Edell, Welter & Schmidt

[57] ABSTRACT

The present invention relates to an improved process of chemically enhanced peat dewatering by pretreatment of the peat substance with an acid and a cationic polyelectrolyte before mechanical dewatering.

7 Claims, 3 Drawing Figures

CHEMICAL ENHANCED FUEL PEAT DEWATERING

BACKGROUND OF THE INVENTION

The overwhelming problem associated with utilizing peat for energy is its high moisture content. Peat in its natural state contains about 90 wt-% water. Most of this water must be removed either mechanically or thermally; otherwise the net energy available from peat is very low. To be considered as a feedstock for conversion to synthetic fuels or for direct combustion, the moisture content of peat should be less than 50 wt-%.

Methods for dewatering wet harvested peat can be grouped into two categories - thermal and mechancial. Thermal methods are very energy intensive and are usually used only after less costly methods of mechanical dewatering have been employed. Several thermal methods such as flash dryers or rotary drum dryers are today commercially available.

Belt and roll presses using mechanical forces have achieved resulting peat moisture contents to about 75 wt-%.

The present invention relates to a process of improving the dewatering properties of peat by addition of chemicals.

SUMMARY OF THE INVENTION

Recent years' development in surface chemistry on model systems with properties similar to peat have shown that the large water keeping capability mainly is correlated to the repulsive forces between parts of colloidal size (usually 10–1000 Angstrom). The repulsive forces in peat are mainly based on electrostatic forces between charged carboxylate group located on the peat particles.

This invention is based on the discovery that the surface properties of the waterkeeping peat particles can be substantially modified by adsorption of chemical additives which eliminate the repulsive forces. A large part of the carboxylates is thus protonated by acid treatment and the remaining charges are neutralized with a cationic polyelectrolyte.

Accordingly, the process has aquired the characterisation given in claim No. 1.

DESCRIPTION AND EXAMPLE

Figure 1:
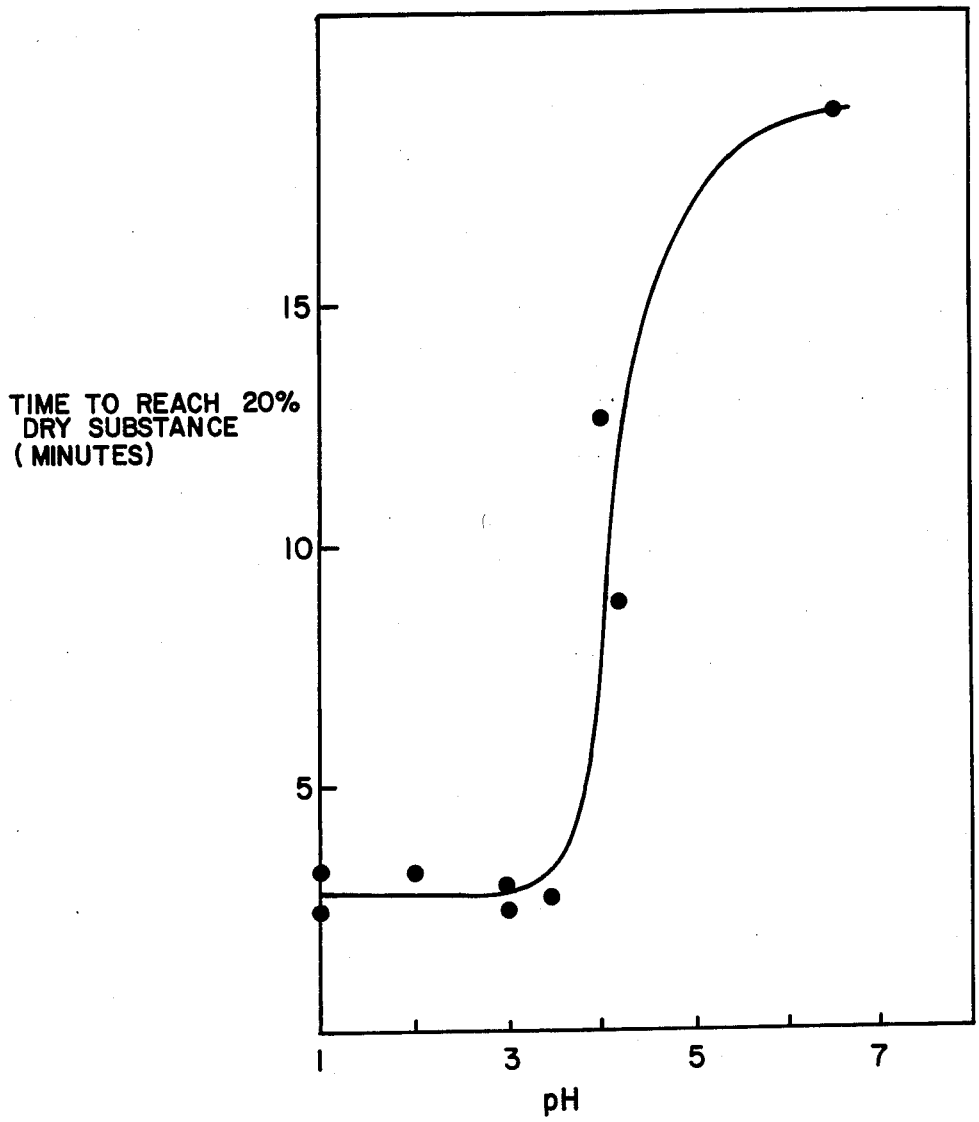
Figure 2:
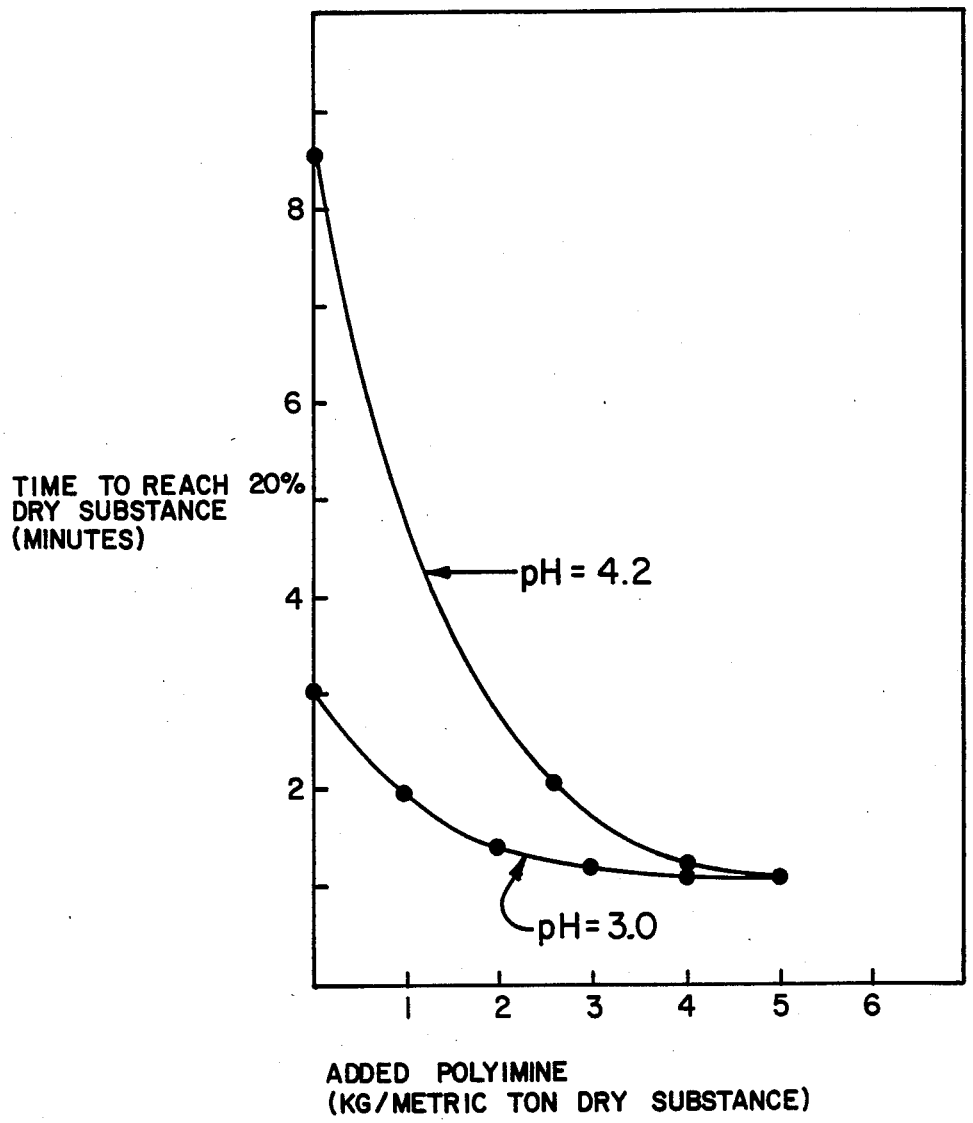
Figure 3:
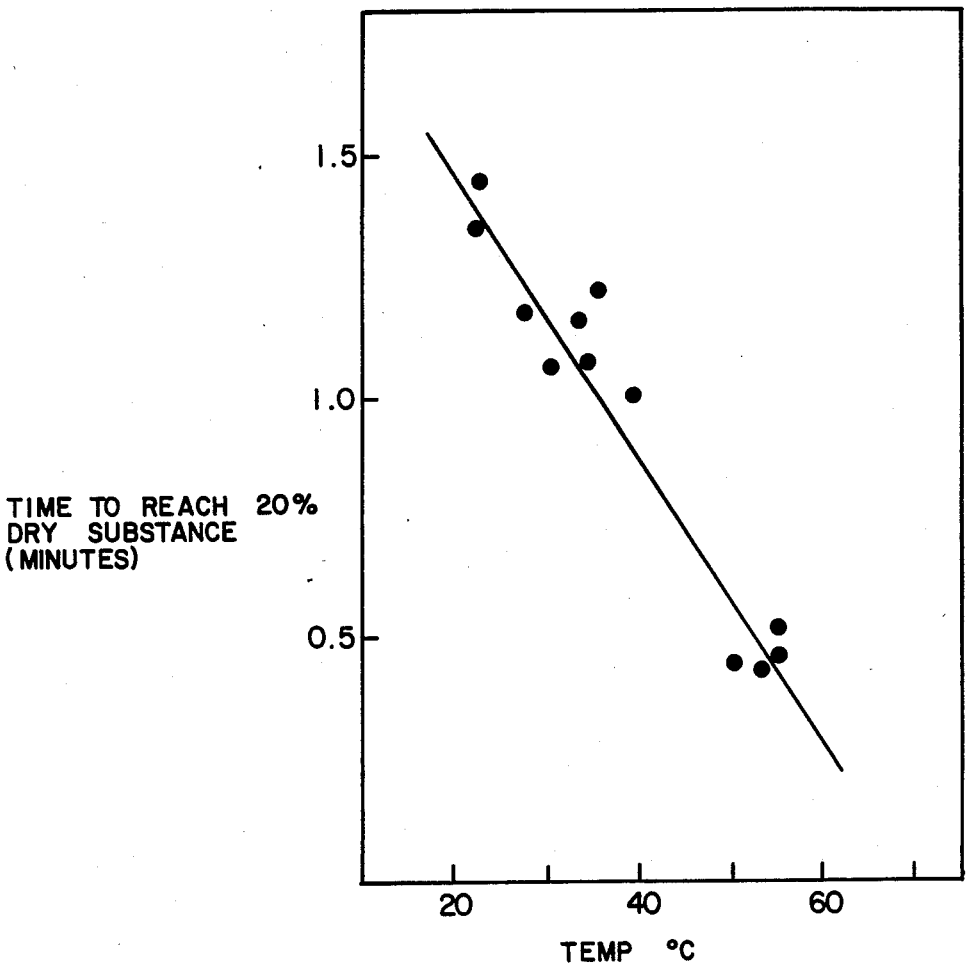

A more detailed explanation of the invention will be given in the following example and enclosed diagrams where;

FIG. 1 shows the relation between the pH-value and time necessary to dewater a given peat quantity to 20% dry substance, FIG. 2 shows the relation between amount of added polyelectrolyte (polyimin) in kg per metric ton of dry peat and time according to FIG. 1, FIG. 3 shows the relation between temperature in degrees Celsius and time according to FIG. 1.

This invention can be practised for example in the following way:

The peat is treated with an acid, for example sulphuric acid, to an optimal pH-value in respect of chemical consumption and dewatering efficiency. The optimal pH-value is often close to or at 3 (FIG. 1). By treatment with acid the negative charges on the colloidal peat particles become almost totally neutralized.

A cationic polyelectrolyte is then added to bind the colloidal peat particles together to larger aggregates.

The polyelectrolyte shall have a charge density adapted to the charge density on the peat particles and a molecular weight preferably exceeding 2000 to enable the polyelectrolyte to further neutralize and flocculate the peat particles.

A polyelectrolyte with a lower molecular weight will solubilize in the continuous water phase in the peat structure and can therefore not create any flocculation or neutralization.

Polyelectrolytes from the group consisting of polyimines and polyamid derivatives are most suitable according to the present invention, but many other cationic polyelectrolytes with molecular weights exceeding 2000 are useable in this invention. The amount of polyelectrolyte to be added is dependent on peat quality, polyelectrolyte structure and degree of pretreatment of the peat with acid. Acid treated peat will generally consume less than 2 kg polyelectrolyte per metric ton, dry peat (FIG. 2) to give the desired dewatering efficiency. This should be compared with polyelectrolyte enhanced dewatering of peat without acid treatment, where polyelectrolyte consumption is in the order of 6 kg/metric ton dry peat.

OTHER EMBODIMENTS OF THE INVENTION

The addition of cationic polyelectrolyte can be combined with an addition of metal salts, preferably iron salts or salts from aluminium and calcium, whereby the polyelectrolyte addition can be further minimized. Also addition of anionic polyelectrolytes to the peat substances such as polycarboxylic acids, can be used to improve flocculation and thereby improve dewatering efficiency.

After chemical treatment the peat should preferably be heated to as high temperature as possible (FIG. 3) before dewatering in the press system. The optimal temperature from an economical point of view is mainly determined by the availability of low quality hot water or steam for example from combustion of peat in the dewatering plant.

By the formation of aggregates according to this invention the water is more easily removed from the peat structure during the press operation, mainly due to the fact that the colloidal particles are flocculated which prevents plugging during water transport through fine channels in the peat structure.

As an alternative to mechanical pressing of the treated peat, centrifuges or other mechanical devices for dewatering can be used when this invention is applied.

Yet another method to improve the dewatering efficiency of peat is a freeze treatment after the chemical treatment. This is only of interest if freezing and subsequent thawing can be realized in an economical way. Freezing can either be performed in shallow lagoons during winter season or in a continuous industrial process, where freezing and thawing can be performed all year around. For certain peat qualities, addition of coal particles or ground dry peat may further improve dewatering efficiency.

A substantial advantage of the present invention relative to prior art additive enhanced peat dewatering is that an acid treatment of the peat in combination with cationic polyelectrolytes reduces the cost of chemicals considerably and cuts the polyelectrolyte consumption with at least 75% at comparable dewatering efficiencies. A further advantage is that the present invention can be combined, as indicated above, with various other methods and chemicals to improve chemical and/or physical peat dewatering.

Having thus described the invention, it is claimed as follows:

1. An improved process of chemical enhanced peat dewatering where the peat substance is treated with an acid and a cationic polyelectrolyte before mechanical dewatering.

2. The improved process according to claim 1 where the cationic polyelectrolyte is selected among synthetic or naturally occuring compounds, including polyimines and derivatives of polyamides.

3. The improved process according to claim 1 where the polyelectrolyte has a molecular weight exceeding 2000.

4. The improved process according to claim 1 where the addition of cationic polyelectrolyte is combined with addition of metal salts, preferably selected among salts of iron, aluminium and/or calcium.

5. The improved process according to claim 1 where addition of ground dry peat and/or pulverized coal particles is made to the chemically treated peat.

6. The improved process according to claim 1 where the chemically treated peat substance is heated before dewatering.

7. The improved process according to claim 1 where the peat is frozen before or after chemical treatment.

* * * * *